US007267184B2

(12) United States Patent
Helms et al.

(10) Patent No.: US 7,267,184 B2
(45) Date of Patent: Sep. 11, 2007

(54) MODULAR HOUSING FOR A ROTARY STEERABLE TOOL

(75) Inventors: Martin Helms, Burgdorf (DE); Satish K. Soni, Celle (DE)

(73) Assignee: Noble Drilling Services Inc., Sugar Land, TX (US)

( * ) Notice: Subject to any disclaimer, the term of this patent is extended or adjusted under 35 U.S.C. 154(b) by 207 days.

(21) Appl. No.: 10/869,540

(22) Filed: Jun. 15, 2004

(65) Prior Publication Data

US 2004/0256153 A1 Dec. 23, 2004

Related U.S. Application Data

(60) Provisional application No. 60/479,607, filed on Jun. 17, 2003.

(51) Int. Cl.
*E21B 7/06* (2006.01)
*E21B 47/024* (2006.01)

(52) U.S. Cl. ..... 175/76; 175/61; 175/45; 175/325.3; 175/24

(58) Field of Classification Search ..... 175/24, 175/61, 76, 325.3, 325.5, 45
See application file for complete search history.

(56) References Cited

U.S. PATENT DOCUMENTS

| | | | | | |
|---|---|---|---|---|---|
| 1,994,819 | A | | 3/1935 | Hartson | 308/4 |
| 2,739,018 | A | | 3/1956 | Collett | 308/4 |
| 2,860,013 | A | | 11/1958 | Medearis | 308/4 |
| 2,874,783 | A | * | 2/1959 | Haines | 166/212 |
| 3,054,646 | A | | 9/1962 | Minor | 308/4 |
| 3,092,188 | A | * | 6/1963 | Farris et al. | 175/76 |
| 3,129,776 | A | | 4/1964 | Mann | 175/76 |
| 4,040,494 | A | | 8/1977 | Kellner | 175/45 |
| 4,241,796 | A | * | 12/1980 | Green et al. | 175/24 |
| 4,394,881 | A | * | 7/1983 | Shirley | 175/76 |
| 5,000,272 | A | * | 3/1991 | Wiebe et al. | 175/73 |

(Continued)

FOREIGN PATENT DOCUMENTS

| | | |
|---|---|---|
| DE | 870 383 | 3/1953 |

(Continued)

OTHER PUBLICATIONS

Notification of Transmittal of The International Search Report and the Written Opinon of the International Searching Authority for International Patent Application No. PCT/US2004/018990, filed Jun. 15, 2004 (12 pages).

(Continued)

*Primary Examiner*—David Bagnell
*Assistant Examiner*—Shane Bomar
(74) *Attorney, Agent, or Firm*—Baker Botts, L.L.P.

(57) ABSTRACT

According to one embodiment of the invention, a rotary steerable tool includes a drive shaft configured to be coupled to a drill string at an upper end thereof and configured to be coupled to a drilling tool at a lower end thereof. A middle portion of the drive shaft is disposed axially between the upper and lower ends and has a smaller diameter than each of the upper and lower ends. The drive shaft further includes a housing rotatably coupled externally to the drive shaft and at least one housing module coupled to a respective opening in the housing at an axial location corresponding to the middle portion of the drive shaft.

25 Claims, 4 Drawing Sheets

U.S. PATENT DOCUMENTS

| | | | | |
|---|---|---|---|---|
| 5,168,941 | A | 12/1992 | Krueger et al. | 175/26 |
| 5,603,386 | A * | 2/1997 | Webster | 175/76 |
| 6,158,529 | A * | 12/2000 | Dorel | 175/61 |
| 6,427,783 | B2 * | 8/2002 | Krueger et al. | 175/40 |
| 6,761,232 | B2 * | 7/2004 | Moody et al. | 175/61 |
| 2003/0051919 | A1 | 3/2003 | Moore et al. | 175/73 |
| 2004/0089477 | A1 * | 5/2004 | Moody et al. | 175/61 |
| 2004/0256162 | A1 * | 12/2004 | Helms et al. | 175/325.2 |
| 2005/0150694 | A1 * | 7/2005 | Schuh | 175/325.1 |
| 2006/0021797 | A1 * | 2/2006 | Krueger | 175/61 |

FOREIGN PATENT DOCUMENTS

| | | |
|---|---|---|
| EP | 0 015 137 | 2/1980 |
| EP | 0 744 526 | 5/1995 |
| EP | 1008717 | 6/2000 |
| WO | WO 01/51761 | 7/2001 |

OTHER PUBLICATIONS

Durant, Marcus; "*Slimhole Rotary Steerable System Now A Reality*", Schlumberger Oilfield Services, Drilling Contractor, Jul./Aug. 2002, pp. 24-25.

Notification of Transmittal of International Search Report and Written Opinion, International application No. PCT/US2004/019275, 15 pages, Sep. 11, 2004.

* cited by examiner

MODULAR HOUSING FOR A ROTARY STEERABLE TOOL

RELATED APPLICATION

This application claims the benefit of U.S. provisional application Ser. No. 60/479,607, filed Jun. 17, 2003, entitled MODULAR HOUSING FOR A ROTARY STEERABLE TOOL.

TECHNICAL FIELD OF THE INVENTION

This invention relates generally to the field of drilling systems and, more particularly, to a modular housing for a rotary steerable tool.

BACKGROUND OF THE INVENTION

Drilling well bores in the earth, such as well bores for oil and gas wells, is an expensive undertaking. One type of drilling system used is rotary drilling, which consists of a rotary-type rig that uses a sharp drilling tool at the end of a drill string to drill deep into the earth. At the earth's surface, a rotary drilling rig often includes a complex system of cables, engines, support mechanisms, tanks, lubricating devices, and pulleys to control the position and rotation of the bit below the surface. Underneath the surface, the drilling tool is attached to a long drill string that transports drilling fluid to the drilling tool. The drilling fluid lubricates and cools the drilling tool and also-functions to remove cuttings and debris from the well bore as it is being drilled.

Directional drilling involves drilling in a direction that is not necessarily precisely vertical to access reserves. Directional drilling involves turning of the drilling tool while within the well bore. Offshore drilling often involves directional drilling because of the limited space beneath the offshore platform, although directional drilling is also vastly used onshore.

Various types of directional drilling tools exist. One type of directional drilling involves rotary steerable directional drilling, in which the drill string continues to rotate while steering takes place. Typically, a plurality of steering ribs are associated with the rotary steerable tool to facilitate the steering. The ribs are disposed outwardly from a sleeve, inside of which is disposed a rotating shaft associated with the drill string. In one type of rotary steerable tool, the outer sleeve rotates and in another the outer sleeve does not rotate. In the type in which the outer sleeve does not rotate, bearings allow relative movement between the outer sleeve and the rotating shaft. High axial and torsional forces are often encountered during this type of drilling.

SUMMARY OF THE INVENTION

According to one embodiment of the invention, a rotary steerable tool includes a drive shaft configured to be coupled to a drill string at an upper end thereof and configured to be coupled to a drilling tool at a lower end thereof. A middle portion of the drive shaft is disposed axially between the upper and lower ends and has a smaller diameter than each of the upper and lower ends. The drive shaft further includes a housing rotatably coupled externally to the drive shaft and at least one housing module coupled to a respective opening in the housing at an axial location corresponding to the middle portion of the drive shaft.

Some embodiments of the invention provide numerous technical advantages. Other embodiments may realize some, none, or all of these advantages. For example, according to one embodiment, a smaller diameter rotary steerable tool may be utilized without having to worry about breakage of the rotary steerable tool due to torsional forces. A smaller diameter rotary steerable tool, with its associated small diameter drill string, may not only be used to drill small diameter bore holes, but may be easily insertable into existing larger diameter bore holes so that new large diameter bore holes do not have to be drilled.

Other advantages may be readily ascertainable by those skilled in the art from the following figures, description, and claims.

DETAILED DESCRIPTION

The following description is directed to a rotary steerable tool associated with a drill string. In one embodiment, a rotary steerable tool facilitates, among other things, more efficient and cost-effective drilling of well bores, especially small diameter well bores. In one embodiment of the, invention, as described below, a smaller diameter rotary steerable tool may be utilized without having to worry about drilling problems, such as breakage of the rotary steerable tool, due to torsional forces encountered when drilling. This is facilitated, in one embodiment, by modular housing that allows the drive shaft of the rotary steerable tool to have a smaller diameter at a location of the electronics and hydraulics used for drilling.

Figure 1:
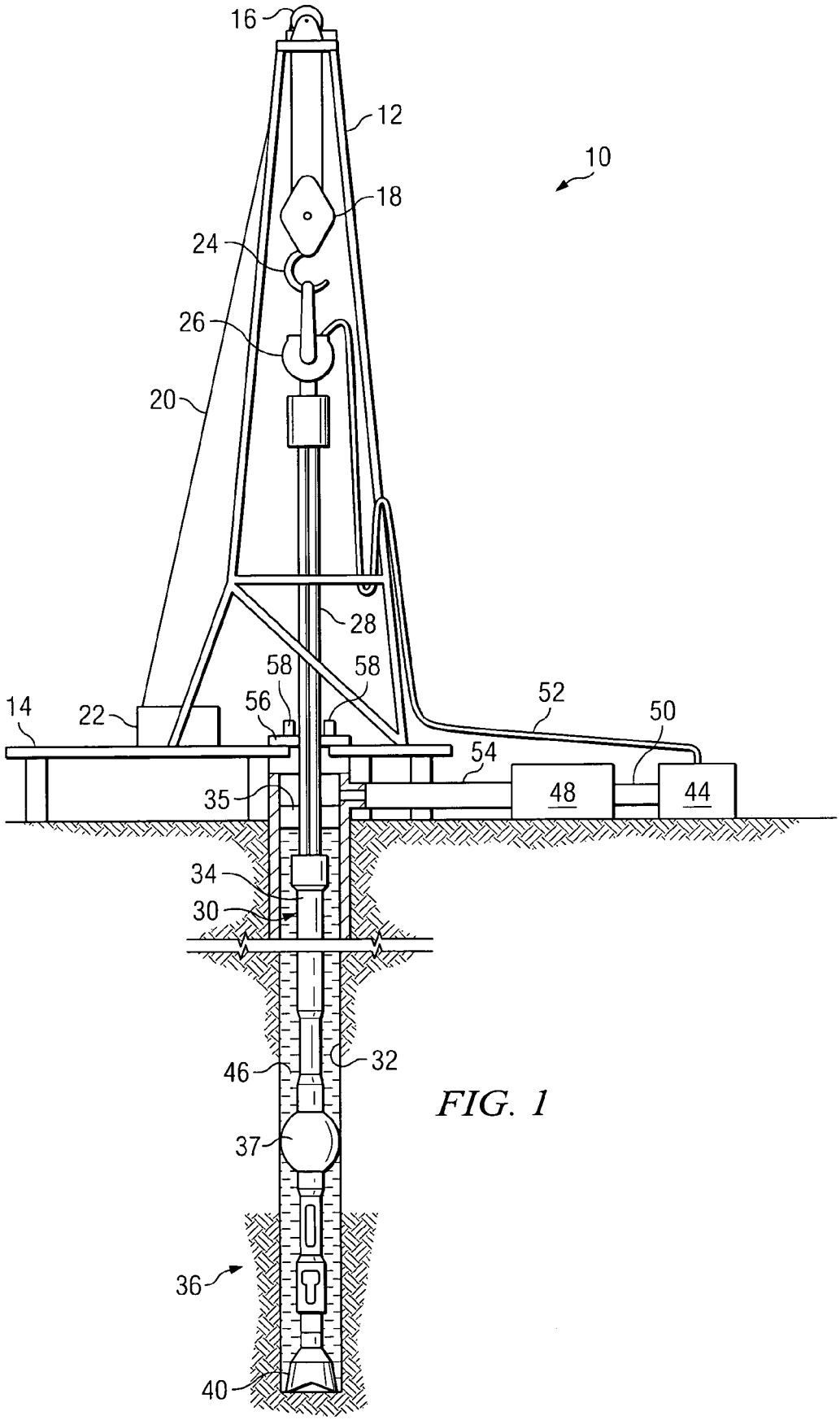
FIG. 1 is a schematic diagram of a drilling rig in accordance with one embodiment of the present invention.

FIG. 1 illustrates a drilling rig 10 in accordance with one embodiment of the present invention. In this embodiment, rig 10 is a conventional rotary table/kelley drive; however, the present invention contemplates other suitable drive devices for drilling rigs, such as top drive, power swivel, and down hole motor. Non-land rigs, such as jack up rigs, semi-submersibles, drill ships, mobile offshore drilling units (MODUs), and other suitable drilling systems that are operable to bore through the earth to resource-bearing or other geologic formations are also useful with the invention.

In the illustrated embodiment, rig 10 includes a mast 12 supported above a rig floor 14. A lifting gear associated with rig 10 includes a crown block 16 mounted to mast 12 and a travelling block 18. Crown block 16 and travelling block 18 are coupled by a cable 20 that is driven by draw works 22 to control the upward and downward movement of travelling block 18.

Travelling block 18 carries a hook 24 from which is suspended a swivel 26. Swivel 26 supports a kelley 28, which in turn supports a drill string, designated generally by the numeral 30, in a well bore 32. A blow out preventor (BOP) 35 is positioned at the top of well bore 32. Drill string 30 may be held by slips 58 during connections and rig-idle situations or at other appropriate times.

Drill string 30 includes a plurality of interconnected sections of drill pipe 34, one or more stabilizers 37, a rotary steerable tool 36, and a rotary drilling tool 40, which may be a drill bit. Drill pipe 34 may be any suitable drill pipe having any suitable diameter and formed from any suitable material. Rotary steerable tool 36, which is described in greater detail below in conjunction with FIGS. 2 through 4D, generally functions to control the drilling direction of drilling tool 40. Rotary drilling tool 40 functions to bore through the earth when drill string 30 is rotated and weight is applied thereto. Drill string 30 may include different elements or more or fewer elements than those illustrated depending on the type of drilling system. For example, drill string 30 may also include drill collars, measurement well drilling (MWD) instruments, and other suitable elements and/or systems.

Mud pumps 44 draw drilling fluid, such as mud 46, from mud tanks 48 through suction line 50. A "mud tank" may include any tank, pit, vessel, or other suitable structure in which mud may be stored, pumped from, returned to, and/or recirculated. Mud 46 may include any suitable drilling fluids, solids or mixtures thereof. Mud 46 is delivered to drill string 30 through a mud hose 52 connecting mud pumps 44 to swivel 26. From swivel 26, mud 46 travels through drill string 30 and rotary steerable tool 36, where it exits drilling tool 40 to scour the formation and lift the resultant cuttings through the annulus to the surface. At the surface, mud tanks 48 receive mud 46 from well bore 32 through a flow line 54. Mud tanks 48 and/or flow line 54 include a shaker or other suitable device to remove the cuttings.

Mud tanks 48 and mud pumps 44 may include trip tanks and pumps for maintaining drilling fluid levels in well bore 32 during tripping out of hole operations and for receiving displaced drilling fluid from the well bore 32 during tripping-in-hole operations. In a particular embodiment, the trip tank is connected between well bore 32 and the shakers. A valve is operable to divert fluid away from the shakers and into the trip tank, which is equipped with a level sensor. Fluid from the trip tank may then be directly pumped back to well bore 32 via a dedicated pump instead of through the standpipe.

Drilling is accomplished by applying weight to drilling tool 40 and rotating drill string 30, which in turn rotates drilling tool 40. Drill string 30 is rotated within well bore 32 by the action of a rotary table 56 rotatably supported on the rig floor 14. Alternatively, or in addition, a down hole motor may rotate drilling tool 40 independently of drill string 30 and the rotary table 56. As previously described, the cuttings produced as drilling tool 40 drills into the earth are carried out of well bore 32 by mud 46 supplied by pumps 44. To direct or "steer" drilling tool 40 in a desired direction, drill string 30 includes rotary steerable tool 36 adjacent to drilling tool 40.

Figure 2:
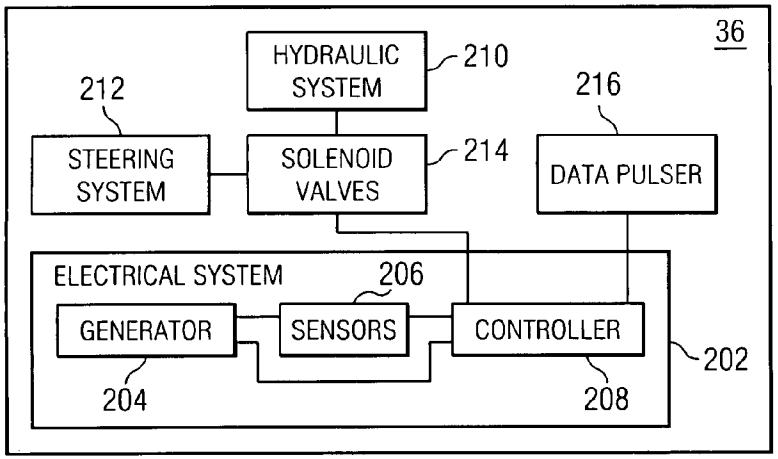
FIG. 2 is a functional block diagram of a rotary steerable tool associated with a drill string of the drilling rig of FIG. 1 in accordance with one embodiment of the present invention.

FIG. 2 is a functional block diagram of rotary steerable tool 36 illustrating some of the components of rotary steerable tool 36 in accordance with one embodiment of the present invention. As illustrated, rotary steerable tool 36 includes an electrical system 202, a hydraulic system 210, a steering system 212, solenoid valves 214, and a data pulser 216.

Electrical system 202 includes a generator 204, a plurality of sensors 206, and a controller 208. Generally, generator 204 provides the electrical power for rotary steerable tool 36. A separate power source (not shown) may also be provided in addition to generator 204 to provide additional power or to provide backup power to rotary steerable tool 36. Generator 204 may also be used to provide power to other elements, components, or systems associated with either rotary steerable tool 36 or drill string 30.

Sensors 206 may include any suitable sensors or sensing systems that are operable to monitor, sense, and/or report characteristics, parameters, and/or other suitable data associated with rotary steerable tool 36, drilling tool 40, or the conditions within well bore 32. For example, sensors 206 may include conventional industry standard triaxial magnetometers and accelerometers for measuring inclination, azimuth, and tool face parameters. The sensed characteristics, parameters, and/or data is typically automatically sent to controller 208; however, sensors 206 may send the characteristics, parameters, and/or data to controller 208 in response to queries by controller 208.

Generally, controller 208 provides the "brains" for rotary steerable tool 36. Controller 208 is any suitable down hole computer or computing system that is operable to receive sensed characteristics or parameters from sensors 206 and to communicate the sensed characteristics or parameters to the surface so that drilling personnel may monitor the drilling process on a substantially real-time basis, if so desired. The data communicated to the surface may be processed by controller 208 before communication to the surface or may be communicated to the surface in an unprocessed state. Controller 208 communicates data to the surface using any suitable communication method, such as controlling data pulser 216.

Data pulser 216 may be any suitable transmission system operable to generate a series of mud pulses in order to transmit the data to the surface. Typically, mud pulses are created by controlling the opening and closing of a valve associated with data pulser 216, thereby allowing a small volume of mud to divert from inside drill string 30 into an annulus of well bore 32, bypassing drilling tool 40. This creates a small pressure loss, known as a "negative pulse" inside drill string 30, which is detected at the surface as a slight drop in pressure. The controlling of the valve associated with data pulser 216 is controlled by controller 208. In this manner, data may be transmitted to the surface as a coded sequence of pressure pulses. Alternate types of pulses that may be used momentarily restrict mud flow inside the pipe. This type is referred to as a "positive pulse."

Figure 4A:
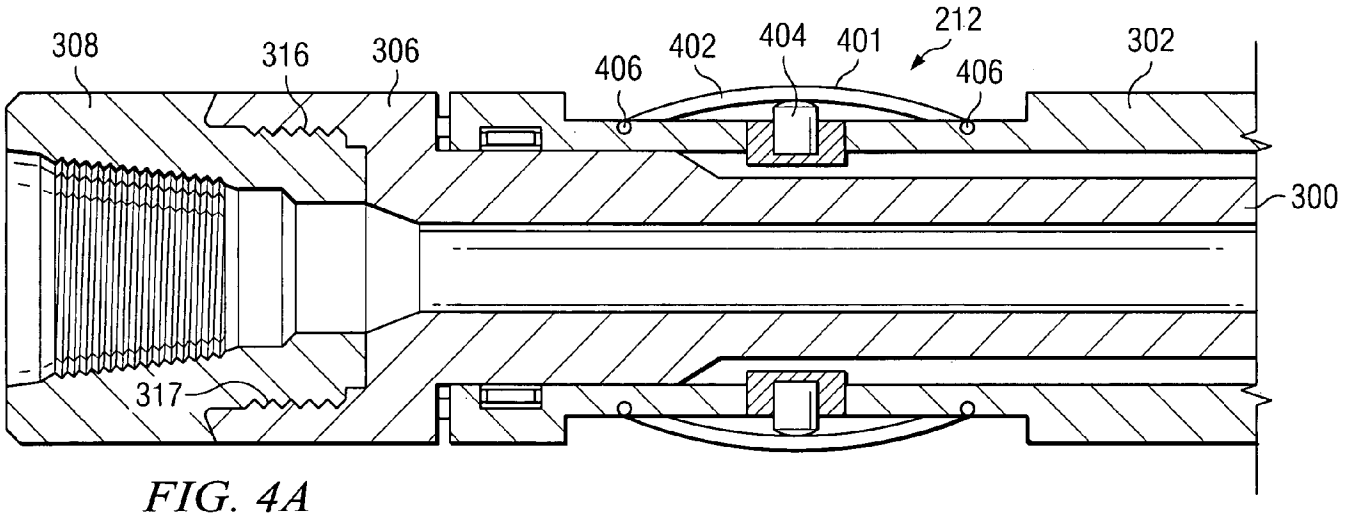
FIGS. 4A through 4D are various cross-sectional views of the rotary steerable tool of FIG. 3 in accordance with one embodiment of the present invention.

Hydraulic system 210 generally functions to provide hydraulic pressure to steering system 212 so that arched spring members associated with steering system 212 may be actuated in a predetermined manner to facilitate the steering of drilling tool 40. The arched spring members, which are described in greater detail below in conjunction with FIG. 4A, are part of steering system 212 along with associated pistons that function to "push out" a respective arched spring member when a respective solenoid valve 214 is opened by electrical system 202. Solenoid valves 214 may be any suitable solenoid valves that are operable to allow hydraulic fluid to pass through hydraulic passages for the purpose of actuating arched spring members via pistons. Controller 208 may function to control the opening and closing of solenoid valves 214.

Figure 3:
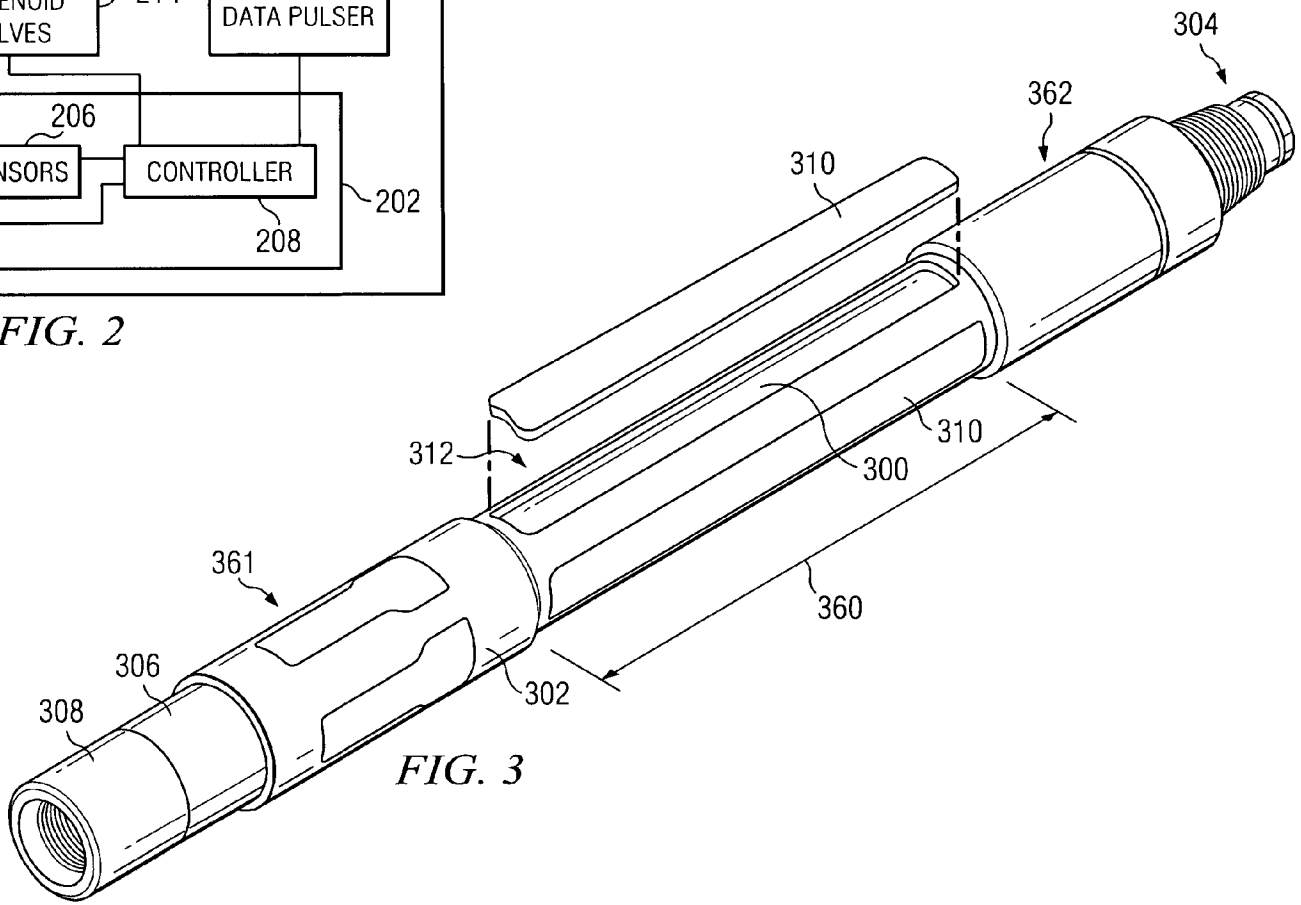
FIG. 3 is a perspective view of an example rotary steerable tool in accordance with one embodiment of the present invention.

FIG. 3 is a partially exploded perspective view of an example rotary steerable tool 36 in accordance with one embodiment of the present invention. In the illustrated embodiment, rotary steerable tool 36 includes a rotating shaft 300, generally referred to as a "drive shaft," rotatably coupled within a non-rotating housing 302, a head end 304, a box end 306, and a saver sub 308.

Rotating shaft 300 is a hollow shaft having any suitable diameter and formed from any suitable material that is coupled to drill pipe 34 via head end 304 and coupled to drilling tool 40 (not explicitly shown) via saver sub 308. In one embodiment, rotating shaft 300 is formed from non-magnetic alloy, such as Monel or Inconel, so that magnetometers used with rotary steerable tool 36 operate properly.

According to one embodiment of the invention, rotating shaft 300 has a variable diameter along its length with its smallest diameter being associated with an intermediate portion of rotating shaft 300. As shown and described in more detail below in conjunction with FIGS. 4A through 4D, in one embodiment, a middle portion 360 of rotating shaft 300 has a smaller diameter than end portions 361, 362 of rotating shaft 300. This facilitates a smaller diameter rotary steerable tool 36 because, as described in more detail below, housing 302 may have a smaller diameter if middle portion 360 of rotating shaft has a smaller diameter. One reason the end portions 361, 362 of rotating shaft 300 may have a larger diameter than middle portion 360 is so that drilling problems, such as breakage of rotary steerable tool 36, due to torsional forces encountered during drilling may be avoided.

Housing 302 houses many of the components of electrical system 202, hydraulic system 210, steering system 212, and data pulser 216, as well as solenoid valves 214, as described in greater detail below in conjunction with FIGS. 4A and 4B. Housing 302 may be formed from any suitable material, usually non-magnetic. Some components associated with housing 302 may be adversely affected by magnetic fields; therefore, the material used to house these elements, such as the elements of electrical system 202, are preferably made of a non-magnetic material, such as Monel or other suitable non-magnetic material.

As described above, a smaller diameter housing 302 may result by providing middle portion 360 of rotating shaft 300 with a smaller diameter than end portions 361, 362 of rotating shaft 300. Solely as examples, housing 302 may have an outside diameter of approximately 4¾ inches or approximately 3½ inches. The smaller diameter housing 302 means that there is less space for such elements as the components of electrical system 202, hydraulic system 210, steering system 212, and solenoid valves 214. Therefore, according to the teachings of one embodiment of the invention, housing 302 includes a set of housing modules 310 that fit within respective openings 312 in the wall of housing 302, as illustrated in FIG. 3.

Housing modules 310, which are described in greater detail below in conjunction with FIGS. 4B and 4C, generally function to house the components of electrical system 202, hydraulic system 210, solenoid valves 214, and other suitable components that allow rotary steerable tool 36 to be utilized for directional drilling. For example, the directional sensing electronics may be disposed within one of the housing modules 310, while the hydraulic system and related components may be disposed within another of the housing modules 310. Any suitable number of housing modules 310 may be utilized around the circumference of housing 302, and they may be spaced around the circumference of housing 302 in any suitable manner. In one embodiment, three housing modules 310 are utilized and substantially equally spaced about the circumference of housing 302. Housing modules 310 may couple to openings 312 in any suitable manner, and are located on housing 302 at an axial location that corresponds to the middle portion 360 of rotating shaft 300.

FIGS. 4A-4D are various cross-sectional views of rotary steerable tool 36 in accordance with one embodiment of the present invention.

FIG. 4A illustrates box end 306, saver sub 308, and steering system 212 associated with housing 302. FIG. 4B illustrates housing modules 310 disposed within openings 312 within the wall of housing 302 and intermediate portion of rotating shaft 300 disposed within housing 302. FIG. 4C illustrates a circumferential cross-sectional view of housing modules 310 and their orientation. FIG. 4D illustrates head end 304 of rotating shaft 300.

Referring to FIG. 4A, box end 306 couples to rotating shaft 300 in any suitable manner. In a particular embodiment, box end 306 is formed integral with rotating shaft 300. Box end 306 has internal threads 316 that function to accept external threads 317 of saver sub 308 in order to couple saver sub 308 to box end 306. Saver sub 308 functions to couple drilling tool 40 thereto and protects box end 306 from damage arising from repeated threading/unthreading of drilling tool 40.

Steering system 212, according to one embodiment, includes a spring member 402 having a bearing surface 401; a pair of mounting pins 406 coupling spring member 402 to housing 302, and a piston 404. Generally, steering system 212 functions to steer drilling tool 40 in a desired direction when arched spring member 402 of steering system 212 is actuated radially by a respective piston 404 such that bearing surface 401 applies a force to the wall of well bore 32. Although bearing surface 401 may have any suitable profile, including a flat surface, bearing surface 401 preferably has a curved profile that substantially matches the profile of the wall of well bore 32 so that an evenly distributed load may be applied thereto.

Spring member 402 is coupled to housing 302 via pins 406. In one embodiment, either one or both pins 406 are disposed within slots formed within the wall of housing 302 to allow for axial movement when piston 404 is actuated. However, spring member 402 may be coupled to housing 302 in other suitable manners.

In one embodiment, there are four steering systems 212 spaced approximately an equal circumferential distance apart around housing 302; however, any number of steering systems 212 may be used.

Also illustrated in FIG. 4A is a transition of rotating shaft 300 to a smaller diameter. This allows space for pistons 404 and their associated fluid conduits (not explicitly shown). In addition, as described in more detail below in conjunction with FIG. 4B, this smaller diameter allows space for housing modules 310.

Figure 4B:
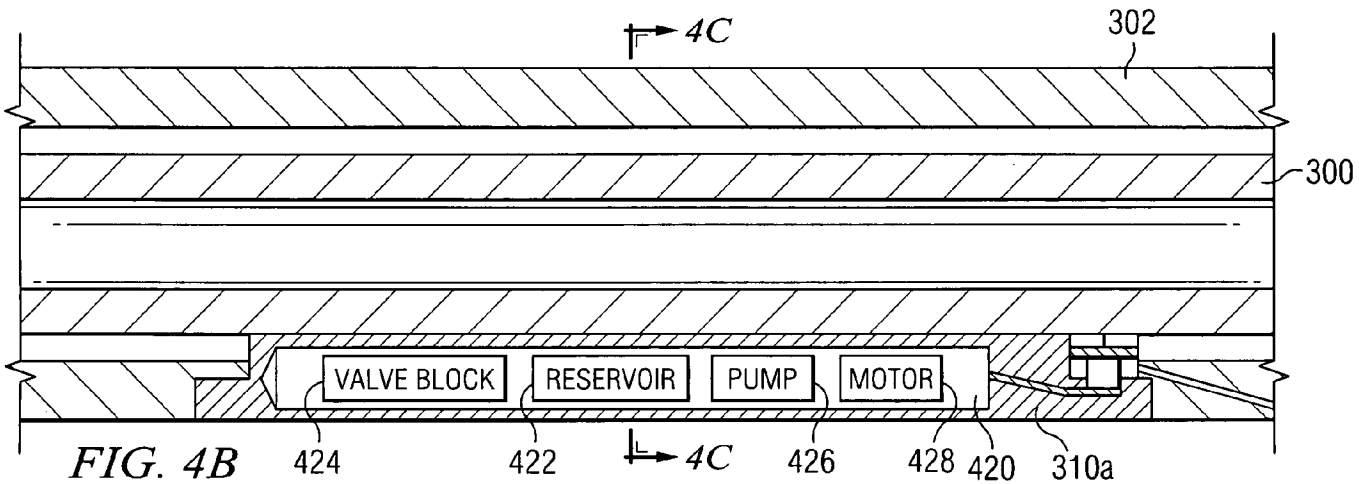
Figure 4D:
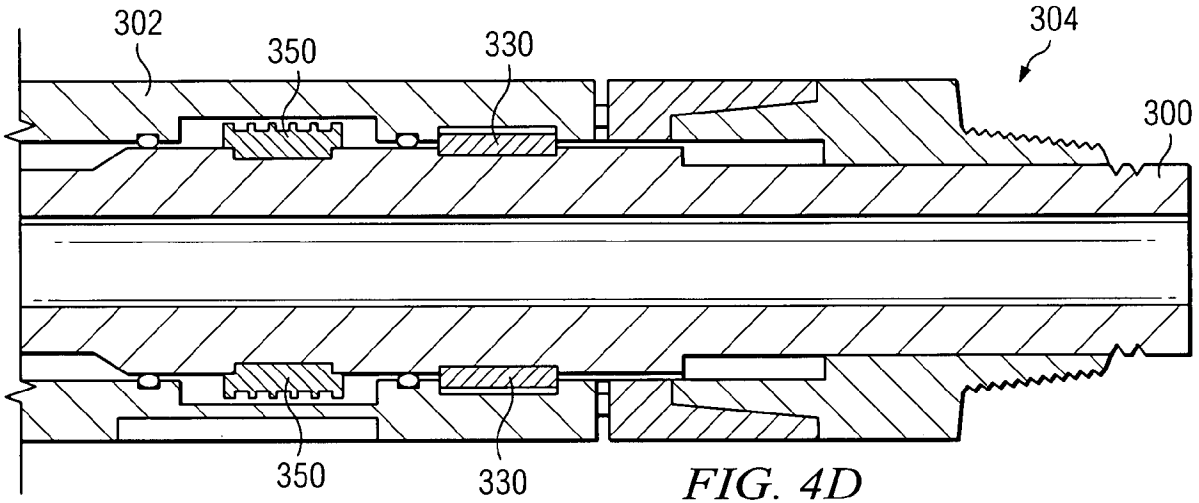

Referring to FIG. 4B, a particular housing module 310 is illustrated. This particular housing module 310*a* is shown to be housing components of hydraulic system 210 via a pressure barrel 420. Any suitable pressure barrel having any suitable configuration may be utilized to house and protect the components therein. Pressure barrel 420 may be sealed from the environment on the outside of rotary steerable tool 36 by any suitable number and type of seals.

In the illustrated embodiment, components of hydraulic system 210 include a hydraulic fluid reservoir 422, a valve block 424, a hydraulic pump 426, and a motor 428 to drive the pump 426. Reservoir 422 houses any suitable hydraulic fluid used to translate pistons 404 for the purpose of actuating spring members 402 in order to steer drilling tool 40, as described above. Valve block 424 facilitate the transportation of hydraulic fluid from reservoir 422 to pistons 404 via suitable hydraulic passages, which may be formed in the wall of housing 302 in any suitable manner and in any suitable location. Hydraulic pump 426 is used to pressurize the hydraulic fluid so there is adequate force exerted on the underside of pistons 404 in order to translate them.

Although not illustrated in the cross-sectional view of FIG. 4B, other housing modules 310 may house components of electrical system 202. These may include a generator, sensors, and a controller. As described above, generator 204 is used to provide power to solenoid valves 214, sensors 206, and controller 208. For example, at the appropriate time, controller 208 directs a particular solenoid valve 214 to open so that pressurized hydraulic fluid from reservoir 422 may translate a particular piston 404 in order to actuate a particular spring member 402 for the purpose of steering drilling bit 40 in a desired direction.

Sensors 206, as described above, operate to sense various characteristics and parameters of the drilling process so that data that is indicative of the sensed characteristics and parameters may be transmitted to the surface in order to effectively control the drilling process form the surface. The measurements from the sensors also cause the controller to operate steering system 212 to steer drilling tool 40 along a pre-programmed trajectory.

Figure 4C:
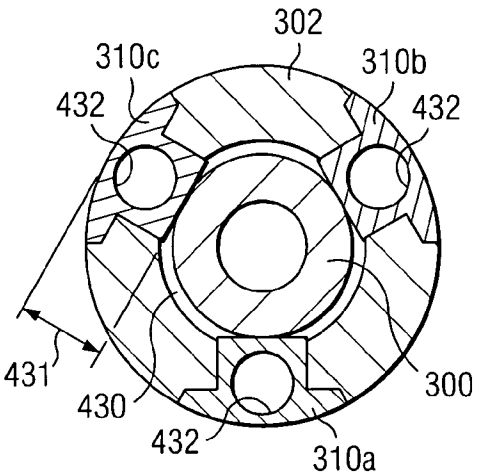

Referring to FIG. 4C, a circumferential cross-section at an intermediate portion of rotating shaft 300 and housing 302 is illustrated. Also illustrated are example housing module 310*a*, 310*b*, and 310*c*. In the illustrated embodiment, modules 310 are substantially equally spaced around the circumference of housing 302; however, other suitable spacing may be utilized.

Also illustrated in FIG. 4C, is an annular space 430 existing between rotating shaft 300 and housing 302. Annular space 430 accounts for the larger diameter at the end portions 361, 362 of rotating shaft 300 so that rotating shaft 300 may be inserted into housing 302. Annular space 430 also allows housing modules 310 to extend beyond an inside surface of housing 302. In other words, a depth 431 of housing modules 310 defines a minimum internal diameter smaller than a minimum internal diameter defined by housing 302. The spacing between the ends of housing modules 310 and outside surface of rotating shaft 300 is typically no more than about two millimeters. Having housing modules 310 to be selectively removable from openings within the wall of housing 302 allows rotating shaft 300 to be inserted into housing 302 before the modules 310 are coupled to housing 302. This extra length of housing modules 310 allows for more space for the hydraulic and electrical components, as discussed above.

As discussed above in conjunction with FIG. 4B, pressure barrels are used to house and protect various components from the environment. These pressure barrels are, in one embodiment, round barrels that fit within openings 432 within housing modules 310, as shown in FIG. 4C.

Referring to FIG. 4D, head end 304 may be coupled to drill pipe 34 in any suitable manner. Also illustrated in FIG. 4D is a pair of slip rings 330 that function to transfer electrical power between rotating shaft 300 and non-rotating housing 302. Any suitable type and number of slip rings may be utilized. A pair of seals, such as Kalsi seals, may be utilized on either side of slip rings 330. One of these seals may be utilized to act as a compensating piston.

To drill well bore 32, weight is applied to drilling tool 40 and drilling commences by rotating drill pipe 34, which rotates head end 304, rotating shaft 300, box end 306, saver sub 308, and drilling tool 40 (not explicitly shown). Concurrently, drilling fluid, such as mud 46, is circulated down through drill pipe 34, rotating shaft 300, and saver sub 308 before exiting drilling tool 40 and returning to the surface in the annulus formed between the wall of well bore 32 and the outside surfaces of rotary steerable tool 36 and drill pipe 34. Rotating shaft 300 is able to rotate within housing 302 by utilizing one or more bearings 350. Any suitable bearings 310 may be utilized, such as roller bearings, journal bearings, and the like.

Although embodiments of the invention and their advantages are described in detail, a person of ordinary skill in the art could make various alterations, additions, and omissions without departing from the spirit and scope of the present invention as defined by the appended claims.

What is claimed is:

1. A rotary steerable tool, comprising:

a drive shaft comprising a lower end, an upper end and a middle portion, wherein the lower end, the upper end, and the middle portion of the drive shaft are formed as a single component to have no separable subcomponents, the drive shaft configured to be coupled to a drill string at the upper end thereof, the drive shaft configured to be coupled to a drilling tool at the lower end thereof, the middle portion of the drive shaft disposed axially between the upper and lower ends having a smaller diameter than each of the upper and lower ends;

a housing rotatably coupled externally to the drive shaft; and at least one housing module coupled to a respective opening in the housing at an axial location corresponding to the middle portion of the drive shaft.

2. The rotary steerable tool of claim 1, wherein a depth of the at least one housing module defines a minimum internal diameter smaller than a minimum internal diameter defined by the housing.

3. The rotary steerable tool of claim 1, further comprising:

directional sensing electronics disposed within the at least one housing module; and a hydraulic system disposed within at least one additional housing module, the at least one additional housing module disposed in a corresponding opening in the housing disposed axially corresponding to the middle portion of the drive shaft.

4. The rotary steerable tool of claim 1, further comprising a plurality of biasing mechanisms coupled to the housing, each biasing mechanism configured to steer the steering tool when actuated by a piston.

5. The rotary steerable tool of claim 4, wherein each biasing mechanism comprises an arched spring member coupled to the housing by a pinned connection and wherein the piston engages an underside of the arched spring member.

6. The rotary steerable tool of claim 1, wherein an outside diameter of the housing is approximately 4¾ inches.

7. The rotary steerable tool of claim 1, wherein an outside diameter of the housing is approximately 3½ inches.

8. The rotary steerable tool of claim 1, further comprising three housing modules substantially equally spaced about the circumference of the housing, each of the three modules disposed in a corresponding opening in the housing at an axial position corresponding to the middle portion of the drive shaft.

9. The rotary steerable tool of claim 1, wherein a clearance between each housing module and an outside surface of the drive shaft is at most about two millimeters.

10. A system for housing a drive shaft of a rotary steerable tool, comprising:

a housing rotatably coupled externally to the drive shaft, the drive shaft comprising a lower axial end portion, an upper axial end portion and a middle portion, wherein the lower axial end portion, the upper axial end portion and the middle portion are formed as a single component to have no separable subeomponents, the housing comprising a plurality of axially extending openings formed in a wall of the housing;

a plurality of housing modules each coupled to a respective one of the openings at an axial location corresponding to the middle portion of the drive shaft, the middle portion having a diameter smaller than a diameter of axial end portions of the drive shaft, each of the housing modules extending radially inward beyond an inside surface of the wall of the housing within an annular space between the housing and the drive shaft.

11. The system of claim 10, further comprising:

directional sensing electronics disposed within one of the housing modules; and a hydraulic system disposed within another one of the housing modules.

12. The system of claim 11, further comprising a plurality of biasing mechanisms coupled to the housing, each biasing mechanism configured to steer the steering tool when actuated by a piston.

13. The system of claim 12, wherein each biasing mechanism comprises an arched spring coupled to the housing by a pinned connection and wherein the piston engages an underside of the arched spring.

14. The system of claim 10, wherein an outside diameter of the housing is approximately 4¾ inches.

15. The system of claim 10, wherein an outside diameter of the housing is approximately 3½ inches.

16. The system of claim 10, wherein a diameter of a circle that can fit inside the inside surfaces of the housing modules is smaller than an inside diameter of the housing.

17. The system. of claim 10, wherein the openings are substantially equally spaced about the circumference of the housing.

18. The system of claim 10, wherein a clearance between an inside surface of each housing module and an outside surface of the drive shaft is at most about two millimeters.

19. A rotary steerable tool, comprising:

a variable diameter drive shaft comprising a lower end, an upper end and an intermediate portion, wherein the lower end, the upper end, and the intermediate portion of the drive shaft are formed as a single component to have no separable subcomponents, the drive shaft having its smallest diameter located along the intermediate portion of the drive shaft;

a housing rotatably coupled externally to the drive shaft, the housing comprising a plurality of axially extending openings formed in the housing proximate the intermediate portion of the drive shaft; and a set of housing modules configured to fit within respective ones of the axially extending openings, each housing module extending radially inward beyond an inside surface of the housing within an annular space between the housing and the drive shaft.

20. The rotary steerable tool of claim 19, further comprising:

directional sensing electronics disposed within one of the housing modules; and a hydraulic system disposed within another of the housing modules.

21. The rotary steerable tool of claim 19, further comprising a plurality of biasing mechanisms coupled to the housing, each biasing mechanism configured to steer the steering tool when actuated by a piston.

22. The rotary steerable tool of claim 21, wherein each biasing mechanism comprises an arched spring member coupled to the housing by a pinned connection and wherein the piston engages an underside of the arched spring member.

23. The rotary steerable tool of claim 19, wherein an outside diameter of the housing is selected from the group consisting of approximately 4¾ inches and approximately 3½ inches.

24. The rotary steerable tool of claim 19, wherein the axially extending openings are substantially equally spaced about the circumference of the housing.

25. The rotary steerable tool of claim 19, wherein a clearance between an inside surface of each housing module and an outside surface of the drive shaft is at most about two millimeters.

* * * * *